United States Patent [19]

Rozmus

[11] 4,025,143

[45] May 24, 1977

[54] ELECTRICAL CONTACTS

[76] Inventor: John J. Rozmus, 1030 Derwydd Lane, Berwyn, Pa. 19312

[22] Filed: June 2, 1976

[21] Appl. No.: 692,226

Related U.S. Application Data

[63] Continuation of Ser. No. 585,616, June 10, 1975, Pat. No. 3,990,864.

[52] U.S. Cl. ..... 339/278 C

[51] Int. Cl.² ..... H01R 3/00

[58] Field of Search ..... 339/278; 113/119; 29/630 C

[56] References Cited

UNITED STATES PATENTS

| | | | |
|---|---|---|---|
| 2,419,469 | 4/1947 | Spiro | 29/630 C |
| 2,646,613 | 7/1953 | Enzler | 29/630 C |
| 3,535,781 | 10/1970 | Comey, Jr. | 29/630 C |
| 3,585,573 | 6/1971 | Robshaw | 339/278 C |

FOREIGN PATENTS OR APPLICATIONS

| | | | |
|---|---|---|---|
| 1,928,957 | 12/1970 | Germany | 339/278 C |

*Primary Examiner*—Joseph H. McGlynn
*Attorney, Agent, or Firm*—Frederick J. Olsson

[57] ABSTRACT

Making a spring contact with a precious metal contact surface by feeding a base strip (from which contact body is made) and a precious metal strip (from which contact surface is made) into progressive die which is tooled to form a spring contact body with slot, to put a section of precious metal strip into the slot, to deform edges of the slot to trap the section, to sever the section and trim the body to form the finished contact.

2 Claims, 11 Drawing Figures

ELECTRICAL CONTACTS

This application is a continuation of my co-pending application Ser. No. 585,616 filed June 10, 1975, now U.S. Pat. No. 3,990,864.

This invention relates in general to electrical contacts and methods for making the same.

More specifically, the invention relates to spring contacts having precious metal contact surfacing which are especially adapted for use in multi-contact type connectors, relays and the like.

Contacts and connectors of the kind mentioned are used in high technology equipment such as communication gear and computers where mechanical and electrical reliability are mandatory.

A single piece of such equipment may employ several hundred and more often several thousand of such contacts and overall billions of such contacts are required by industry each year.

There is a compelling need for techniques which will economically mass produce highly reliable contacts of the kind in question.

The primary object of the present invention is to provide methods which will fill that need.

The invention contemplates using a base strip (from which the contact spring is made) together with a precious metal strip (from which the precious metal surfacing is made) and feeding these strips into a progressive die which will uniquely work and join the strips and discharge fully formed contacts at a very rapid rate, for example, ten thousand per hour.

The two most important advantages of the invention are reliability and economy.

With respect to reliability, the spring contact and the precious metal surfacing are mechanically joined together so that physical and electrical integrity are maintained irrespective of large fluctuations in temperature which is normally associated with equipment heretofore mentioned and even with repeated use in edge-board connector applications.

With respect to economy, the strips-in/contacts-out operation is fully automatic and eliminates separate multiple operations, handling and inspection. Thus tooling, assembly labor and overhead are held to a minimum. Moreover, the precious metal surfacing can be precisely tailored to the application so that the amount of such metal needed is simply that which is essential and no more. The invention will be described below in connection with the following drawings wherein.

Figure 1:
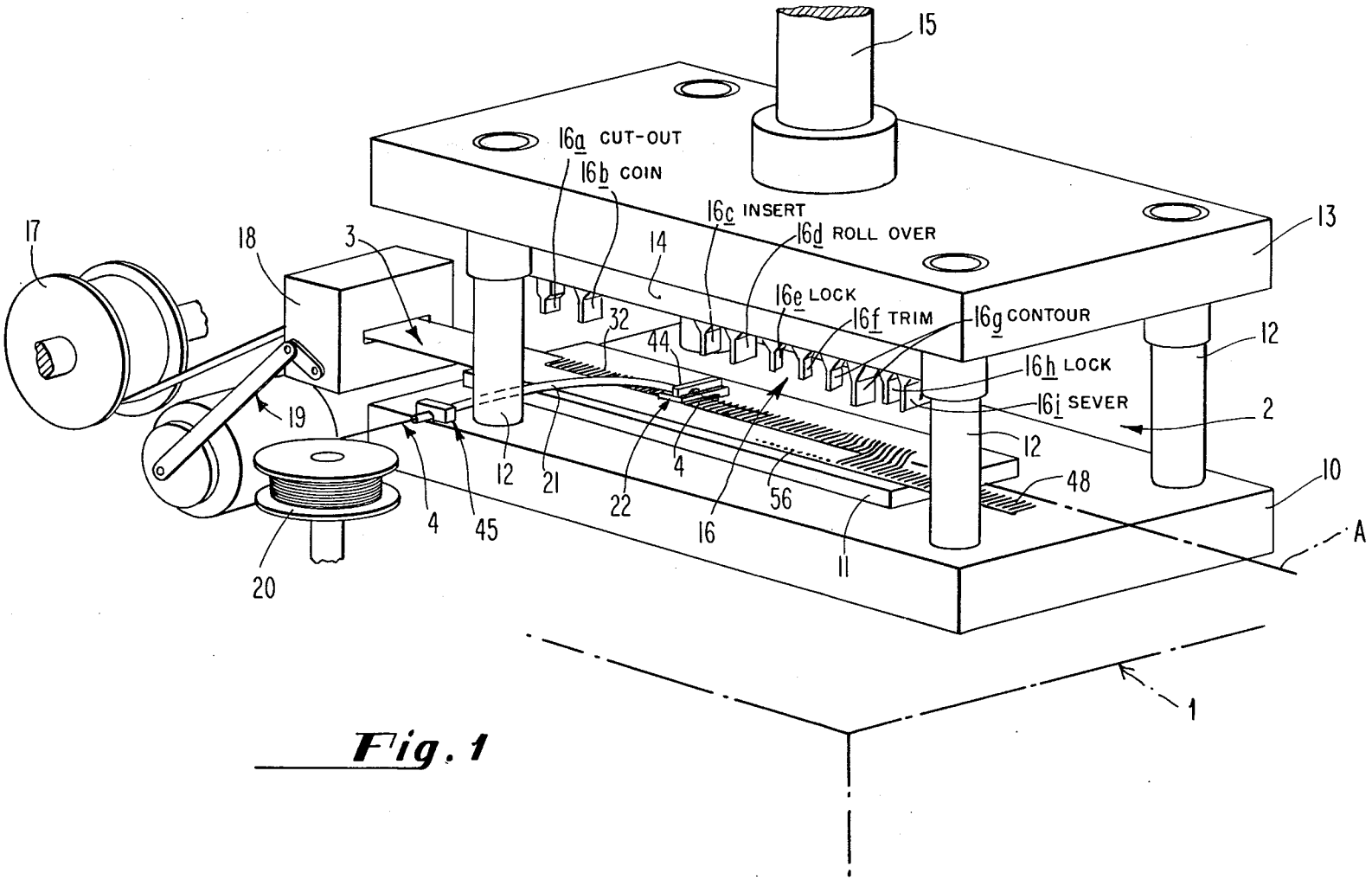
FIG. 1 is a perspective view of a progressive die adapted for practicing the invention.

In FIG. 1, I have illustrated a portion of a press 1 incorporating a progressive die 2 arranged to receive and work the body strip 3 and the surface strip 4. Various of the areas of the body strip 3 and surface strip 4 are shown as being worked by the die as the strips progress thru the die along the axis A. The die works the strips into a finished contact.

Figure 2:
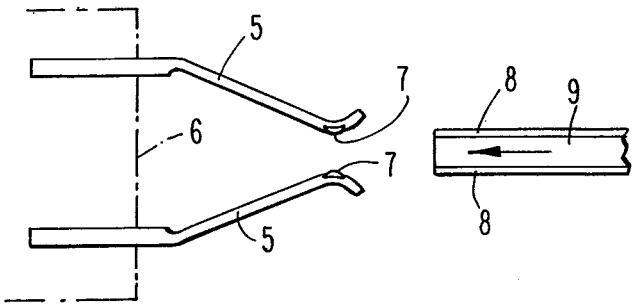
FIG. 2 is a diagramatic view of a spring contact made in accordance with the invention and employed in an edge-board connector.

A typical spring contact for use with edge-board connectors will be used for purposes describing the invention. A pair of such identical contacts 5 mounted in the insulator 6 are shown in FIG. 2. Each has a gold surfaced contact element 7 (made from surface strip 4) for establishing an electrical connection with the conductors 8 of the edge-board connector 9. While the contacts 5 are contoured it will be understood that the invention is equally applicable to non-contoured contacts.

The die 2 includes the die bolster 10 mounted on the press and carrying the die pad 11. The guide pins 12 are mounted in the die bolster 10 and carry the punch pad bolster 13 which mounts the punch pad 14. The punch pad bolster 13 is adapted to be reciprocated by the press drive means indicated at 15.

The punch pad 14 carries a purality of punches 16 and the die pad 11 carries the corresponding dies (not shown). The respective mating punches and dies are spaced at stations along an axis A which extends left to right thru the die. Stripper plate mechanism needed in dies of this kind has been omitted for purposes of clarity. It will be understood that the stripper plate guides the strip along the axis A and maintains the strip against lateral movement.

The body strip 3 is mounted on a roll 17 and is pulled off the roll and intermittently fed between the punches and dies by the feed 18 operated by the motor-eccentric mechanism 19. The intermittent motion of the feed 18 is co-ordinated with the reciprocating motion of the press drive 15 so that the punches 16 operate during the dwell of the strip.

The surface strip 4 is mounted on roll 20 and is conducted into position by the guide tube 21 which directs the strip into a funnel mechanism 22 mounted over the strip 3. The surface strip 4 is intermittently pulled thru the die by the body strip 3 as will be explained later.

It will be understood that the punches hit the strips during a dwell period and that the feed of the strips takes place after the punches leave the stripper plate on the return stroke and before the next working stroke.

With respect to the punches 16 and their corresponding dies, the actual physical structure of these is not shown as the same will be readily apparent to those skilled in the art particularly upon being appraised of the type of operations and the results desired in performing the various steps of the invention.

A typical body strip employed in forming the spring contacts of the invention has a rectangular cross section with a thickness of approximately 0.028 inches and a width of approximately 1 5/32 inches and is formed of a copper alloy.

Figure 3:
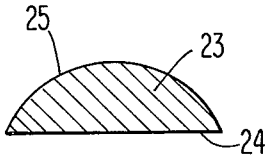
FIG. 3 is a cross sectional view of a typical surface strip.

A typical surface strip employed for making spring contacts of the invention has a cross section as indicated in FIG. 3. The base 23 has a flat bottom 24 and a top contact surface 25 which is contoured in shape. The width of the strip is approximately 0.035 inches and the maximum height is approximately 0.007 inches.

The base provides mechanical strength for the surface strip particularly as needed for the working operations as described hereafter. The base is preferably made of the same copper alloy as the body strip. The surface 25 has an integral film of precious metal which is preferably gold. The gold is inlayed on the base and has a thickness of not less than approximately 0.00005 inches. The gold surface is used for establishing an electrical connection with a mating electrical conductor.

With the above in mind I will now explain the feeding of the body strip and the surface strip into the progressive die and how the same are worked to form the finished contact 5.

Figure 4:
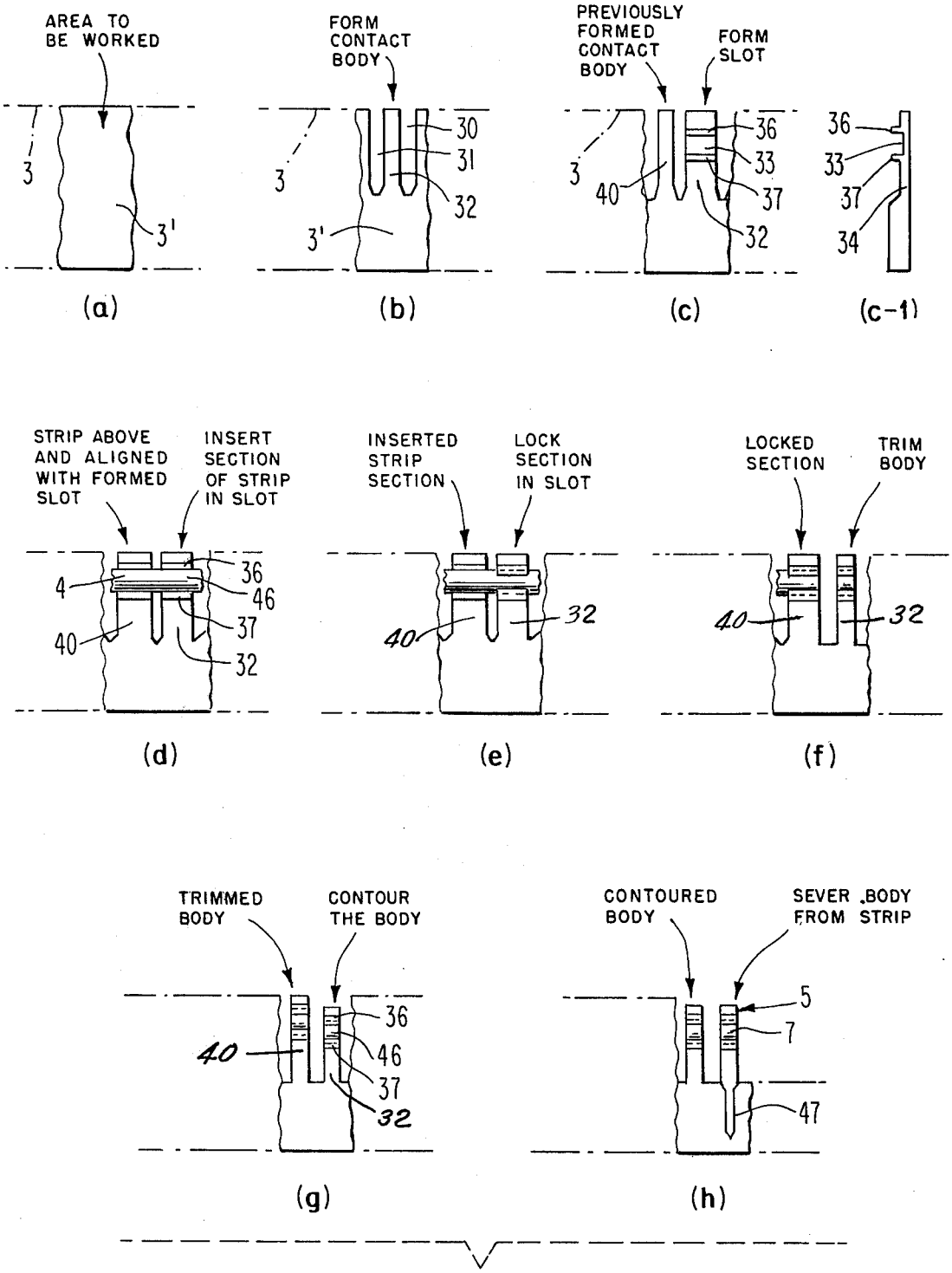
FIG. 4 is an exploded view diagrammatically illustrating various steps performed in practicing the invention.

Referring to FIG. 4 I have diagrammatically shown in parts (a) thru (h) the results of various successive operations as performed on single areas of the body and surface strips. In FIG. 4 the single area of the body strip is indicated at 3'. A single area is used simply for the sake of clarity. It will be understood that adjacent areas all along the strips are simultanously being worked as the strips pass thru the die. This is indicated in FIG. 1. In each of the parts (b) thru (h) I have shown the condition of the strips both for the operation performed and the operation just previously preformed.

Referring to FIG. 4 part (a) area 3' is in a dwell state under punch 16 *a* of FIG. 1. The punch hits the strip to form an elongated cut-out 30. After movement of the strip the same punch hits again the strip to form parallel cut-out 31. This forms the elongated section 32 which will be hereinafter referred to as the contact body. In FIG. 1 several of these contact bodies are shown as formed in the strip 3.

In FIG. 4 part (c) the contact body 32 is coined to form the capture slot 33. This operation is performed by the punch 16 *b* shown in FIG. 1. In the spring contact formation being described, the contact is of the type which requires contouring and for this purpose a portion of the body 32 is reduced in thickness as illustrated at 34 in part C-1.

Figure 6:
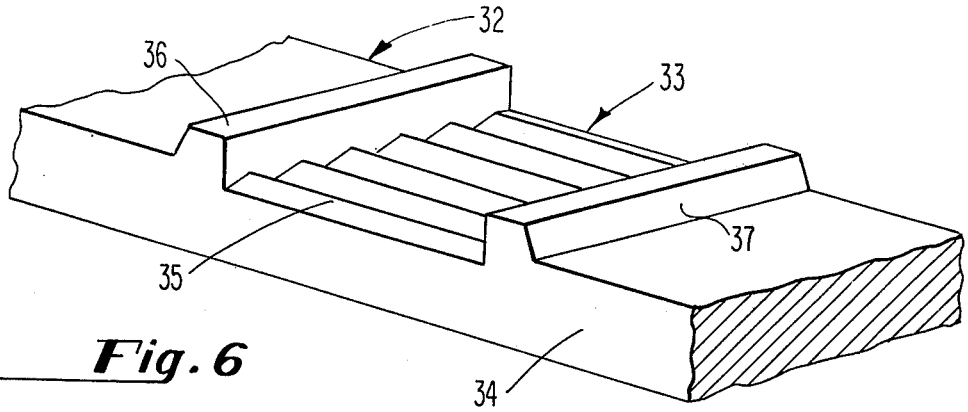
FIG. 6 is an enlarged fragmentary view diagrammatically illustrating a slot in the body strip for capturing the surface strip.

An enlarged view of the capture slot 33 is shown in FIG. 6. The slot runs transverse to the contact body and the bottom of the slot has serrations 35 which extend lenghtwise to the body or transverse to the slot. Along the respective edges of the slot are formed projections 36 and 37. As will be noted later, the serrations and projections are used to lock a section of the surface strip 4 in the slot to form the contact element 7 (FIG. 2).

While I have illustrated the coining operations as including the formation of slot 33 and reduced section 34 as being performed by a single punch 16 *b* it will be understood that more than one punch may be used for this operation depending upon the work hardening and flow characteristics of the metal.

Note that in part (*c*) adjacent the coined body 32, I have shown contact body 40 which is the same as the body 32.

It will be noted that reducing the thickness of the contact body 32 causes the same to widen. This is trimed off to form the finished contact with the desired width as will be noted later.

After the capture slot 33 has been coined the surface strip 4 is fed over the strip 3 in alignment with the slot.

With reference to FIG. 1 all of the elongated bodies 32 in the space between the punch 16 *b* and funnel mechanism 22 have been coined with a slot as above mentioned. These elongated bodies are stepped along under the funnel 22 in condition to receive the surface strip 4 in the respective slots. The alignment operation will be described following particularly in connection with FIG. 5.

The funnel 22 is screwed down on the pad 7 and has an extension 41 which projects out over the strip 3. The extension has a bore 42 which has the same cross sectional shape as the surface strip 4 and is dimensioned so that the strip will slide thru the bore without binding. The end 43 of the guide tube 21 is positioned closely adjacent the entrance of the bore 42 (left hand end) so that the strip 4 exits from the tube directly into the bore. The strip exits on the right hand end of the bore. The tube 21 is held on the funnel as by the weld or solder 44. With reference to FIG. 1 the opposite end of the tube 21 is secured on the die bolster as by the clamp 45.

The axis of the bore 42 is parallel the axis A. The funnel is positioned with respect to the axis A so that with each step of the body strip 3 a contact body appears closely adjacent the bore exit for example see the body 40 in FIG. 5. Thus as the surface strip 4 exits from the bore it is directly over in vertical alignment with the capture slots in the body strip.

Figure 5:
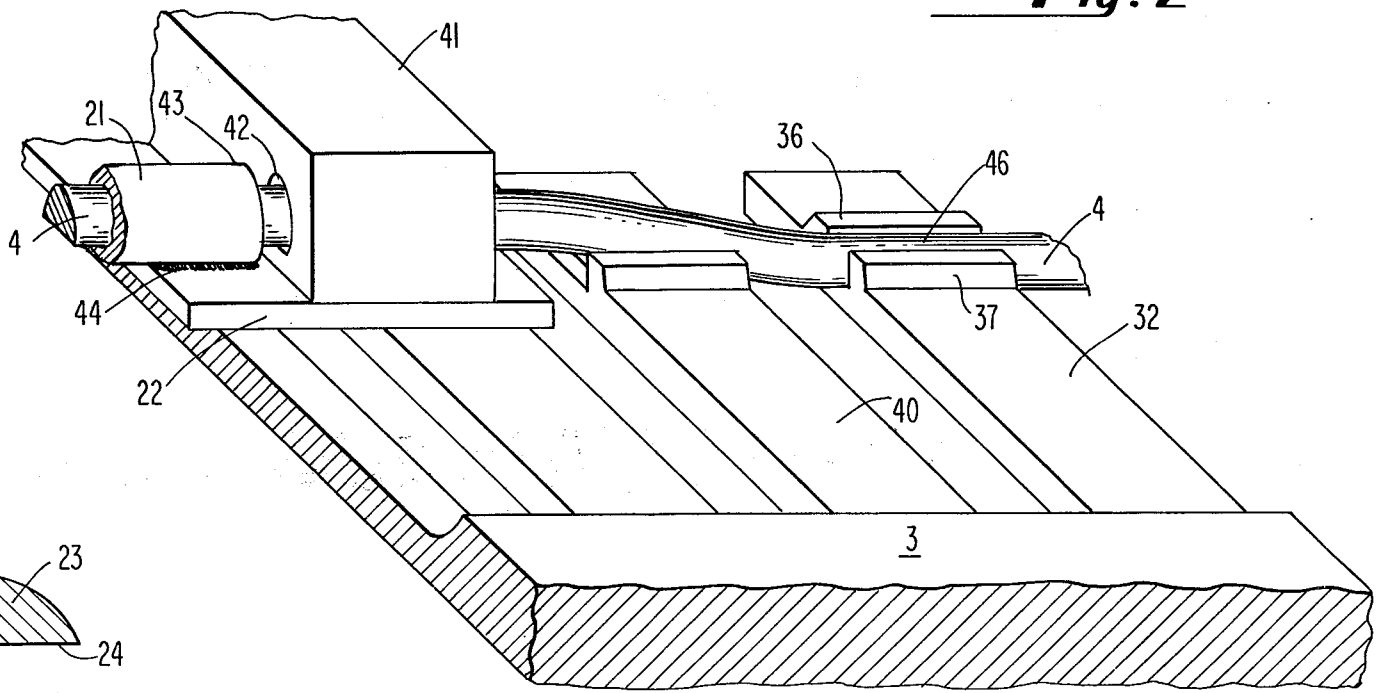
FIG. 5 is an enlarged fragmentary view illustrating the mechanism for aligning the surface strip with the body strip.
Figure 7:
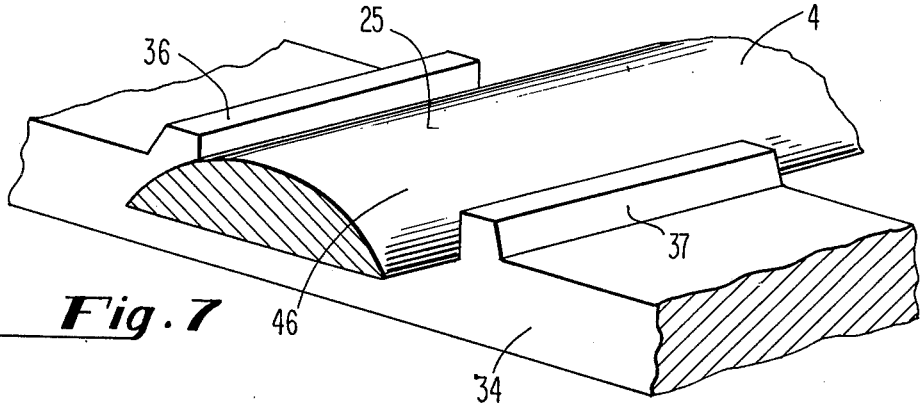
FIG. 7 is an enlarged fragmentry view of the surface strip inserted into the capture slot.

With proper alignment, the next operation involves inserting small sections of the surface strip in the capture slots. This is done by the punch 16 *c* in FIG. 1. In FIGS. 5, 7 and in FIG. 4 part (*d*) the small section 46 has been inserted. It is this section 46 that will eventually form the contact element 7.

The punch 16 *c* hits the contact surface 25 of the section 46 and drives the section down into the slot so that the serrations 35 tightly intermesh with the bottom 24. Ideally, the serrations detent into the bottom as will be the case when the serrations are harder than the material of the surface strip because of work hardening in the coining operation.

Note in FIG. 7 that the top portion of the contact surface 25 is spaced outwardly of the contact body and is located above the projections 36 and 37. This is to ensure that a desired portion of the contact surface is available for establishing an electrical connection.

With reference to FIG. 4 part (*d*) note that contact body 40 having a capture slot the same as slot 33 is below the surface strip 4 in ready condition to receive a section of the surface strip after the next feed step of the body strip 3.

The next operation involves trapping and locking the section 46 of the surface strip in the capture slot. The result of the operation is diagrammatically illustrated in FIG. 4 part (e) and in FIGS. 8 and 9.

Figure 8:
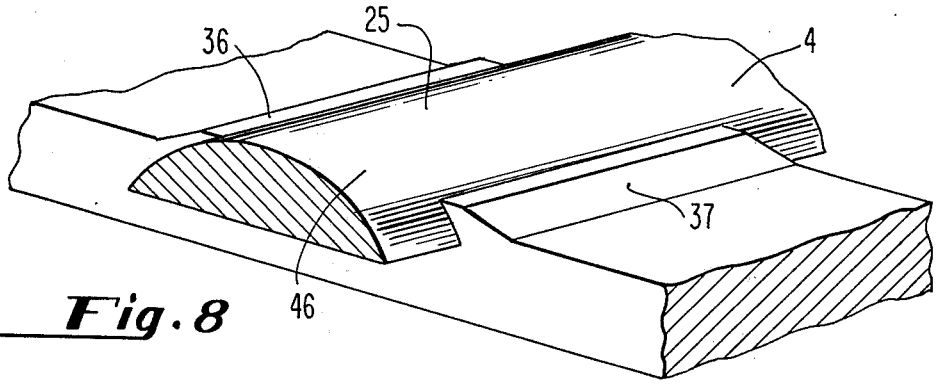
FIG. 8 is an enlarged fragmentary view illustrating how the surface strip is first trapped in the slot.

With reference to FIG. 8 the first operation involves deforming the projections 36 and 37 so that they are pushed sidewise or rolled over toward and onto the contact surface 25 of the section 46. The engagement of the deformed projections and the surface 25 pushes the strip tightly into the slot and captures the same in position. The effect of this is that when the body strip 3 is moved or stepped along it pulls the surface strip along with it. Thus the body strip and the surface strip move in synchronism for the remaining operations. Note with reference to FIG. 8 that the exposure of the top portion of the contact surface 25 is maintained by the operation.

The rollover operation is performed by the punch 16 *d* shown in the FIG. 1. The punch is configured to strike the projections 36 and 37 simultaneously. The projections are then further deformed to spread the metal of the projections over a wider area of the contact surface 25 while still maintaining the exposure. This is done by the punch 16 *e* and is further illustrated in FIG. 9. The effect of further deforming the projections is to fix the section 46 firm in the slot and to positively establish an electrical connection between the section and the slot.

Note in FIG. 4 part (e) that the capture slot in the contact body 40 has received a section of the strip (as in part (d) ) and is in ready condition for the locking operation.

The next operation involves separating the section 46 from the strip. This is done by the trimming punch 16 *f* and the result is diagrammatically illustrated in FIG. 4 part (f).

The spring contact being described is designed to have a narrower width than the resulting from the coining operation and therefore the trimming operation of part (f) also involves trimming off the sides of the contact body. Thus, in part (*f*) it will be noted that the width of the contact body 32 is less than the width as shown in part (*e*). The punch 16 *f*operates by first hitting the leading edge of the contact body 32 to trim off the excess of the body 32 and of the section 46. On the second hit, the punch trims the trailing edge. This separates the section 46 from the strip 4.

The material trimmed from contact body 32 and section 46 are pushed down thru cavities in the die to a scrap collector.

Note in part (*f*) the capture slot of the contact body 40 has trapped a section of the strip 4 and the body and section are ready for the trimming operation. Note also in part (*f*) that the trimming operation severs the leading edge of the section locked in the capture slot of body 40.

After the trimming and separating operation, the contact body is contoured to form the general shape as noted in FIG. 2. The contouring is preferably accomplished in two stages as by the punches 16 *g*.

In the event the contouring operation has a tendency to lessen the degree of locking achieved by the punches 16 *d*and 16 *e* it is preferable, after the contouring operation, to hit the projections 36 and 37 and the section 46 with the punch 16 *h* so as to insure the locking condition.

With the body contact having the correct width and contour the next step is to sever the contact from the strip 3. This is indicated in FIG. 4 part (*h*) wherein the punch 16 (*i*) cuts the strip 3 along the line 47 and pushes the contact down thru a cavity not shown to a collector.

After the contact is released from the strip the unused portion 48 of strip 3 continues to exit from the machine to a scrap collector not shown. An additional punch may be provided after the punch 16 *i* which functions to sever the unused portion and push down thru a cavity to a collector.

Figure 11:
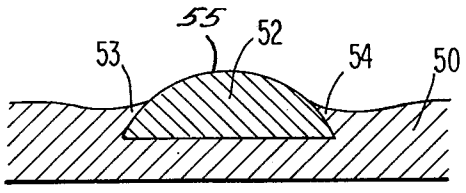
FIGS. 10 and 11 are elevational views illustrating an additional technique for locking a section of the surface strip in the slot.
Figure 10:
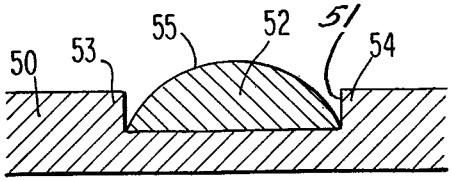

The method of locking the surface strip section 46 in the capture slot as described above is preferred. However, an acceptable alternative is illustrated in FIGS. 10 and 11. The contact body 50 has a capture slot 51 formed without projections such as 36 and 37. Also, the slot is deeper than the slot 33. After the surface strip section 52 is inserted in the slot the opposite edges 53 and 54 of the contact body are deformed as noted in FIG. 11 so that the material flows over in engagement with the contact surface 55 of the section 52.

With respect to locking the surface section in the capture slot in the embodiments described above it is pointed out that the serrations operate to hold the section from moving in either direction along the slot axis and that the deformed projections 36 and 37 operate to hold the section from moving out of the mouth of the slot. The use of serrations is preferred. However, the serrations are omitted particularly in contacts where a judicious amount of projection metal is available for deforming over and into tight engagement with the surface strip section.

Figure 9:
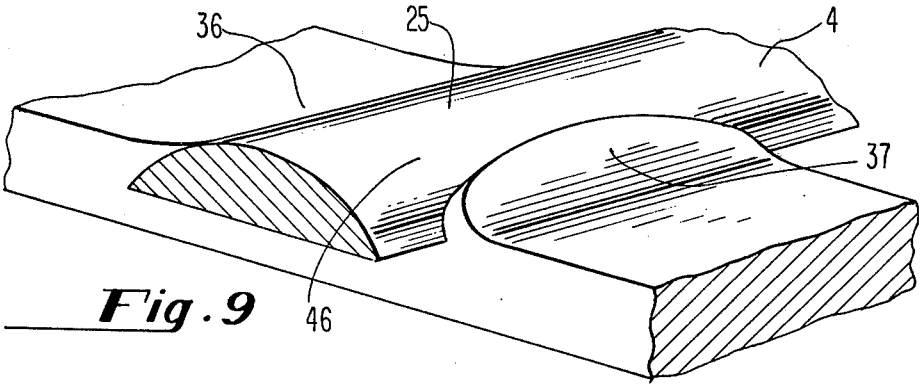
FIG. 9 is an enlarged fragmentary view showing how a section of the surface strip is locked in the slot.

In the formation of the contact described above the contact surface 25 has a shape as shown in FIGS. 7–9. Thus in mating with the conductors 8 of the edge-board connector 9 a line contact is established.

It is contemplated that for connections requiring a point or small area contact, the contact surface is formed with a generally semi-spherical contour. In such instances additional punches are provided after the contouring operation which operate on both the projections and on the opposite edges of the section to deform the same so that the central part of the section is raised and rounded and each projection is spread over the contact surface.

In connection with the formation of the contact surface 25 as shown in FIGS. 7–9, I contemplate shaping the punches 16 *g* an 16 *h* (or provide additional punches) to work the outer edges of the section 46 to slightly round off the same. This is advantageous for contacts used in edge-board connector applications to avoid damage where the board is incorrectly inserted at an angle.

In connection with setting up the strips 3 and 4 to run thru the progressive die, the preferred manner of initially joining the strips 3 and 4 is noted following.

First, the strip 3 is run thru the die without the strip 4 until several finished contacts have been discharged. The press is stopped. The strip 4 is threaded thru the tube 21 and thru the funnel 22 and then inserted by hand in the capture slot under the insert punch 16 *c*. The strip extends beyond the slots into the next several contact bodies. Then the press is started up and the operations as previously described then take place.

As mentioned earlier the stripper plate has not been shown but it will be understood that the plate is configured to accommodate the tube 21 and the funnel 22. Also it is pointed out that in the trim/contour section of the die the stripper plate preferably is a spring-type mechanism.

Note also that with reference to FIG. 1 that I provide a punch (not shown) to form the pilot holes 56 for setting the strip advance.

It is vitally important that the contact element 7 be permanently locked on the contact body. By permanent it is meant that the element will not come loose under conditions of the intended use.

The collective effect of the operation of locking punches 16 *d*, 16 *e* and 16 *h* is to mechanically capture the element 7 in the slot for purpose of achieving the permanent condition. In the formation of contacts where fewer than three locking punches (say even one punch) are used it is necessary that the operation mechanically capture the contact element for the purpose stated.

In connection with achieving permanency, it is necessary that the metal selected for the body and surface strips have substantially the same coefficient of expansion. Thus it is preferred that the strips be made of the same metal. I contemplate compatible expansion and contraction behavior of the metal of the contact body and the contact element whether the temperature is due to ambient conditions or due to IR drops. The foregoing is to avoid degrees of expansion or contraction which are so different that the contact element becomes loose.

From the foregoing description it will be apparent that the contacts are formed consecutively, that is to say, the contacts are formed and discharged one following the other in uninterrupted succession. The various steps for the consecutive formation of the contacts are performed at dwells successively on a given area as that area is stepped thru the die but not necessarily at consecutive dwells since the punches are physically separated. Also, as mentioned previously, the several steps for the consecutive formation of the contacts are performed simultaneously on the body and surface strips, i.e., while a cut-out is being formed on one area, another area is being coined, in another area a section is being inserted etc. etc.

1. A spring contact having a precious metal contact surface comprising:

an electrically conductive, elongated, stamped metal body made of resilient material;

an open ended slot extending transverse and thru the body from the edge to edge thereof and being located adjacent one end of the body;

an electrically conductive metal section having a metal base and an integral, precious metal contact surface, the base being disposed in said slot in electrical connection therewith and extending thru said slot with the respective ends of the base being flush with said edges of the body and the surface being located outwardly of the body for establishing an electrical connection with a mating electrical conductor and the base providing mechanical strength for the section and the metal of the base having substantially the same coefficient of expansion as the metal of the body; and on each of the opposite sides of the slot, the body material extending over and tightly engaging the contact surface, the engagement permenently fixing the section in the slot and providing for exposure of a substantial portion of the contact surface for making said electrical connection with a mating conductor.

2. The contact of claim 1 wherein the bottom of the slot has serrations which extend into the bottom of the section.

* * * * *